United States Patent [19]

Hogue

[11] 4,333,256

[45] Jun. 8, 1982

[54] CLOTHES PIN STIRRUP FASTENER FOR UNITARY PISTOL HAND GRIP

[75] Inventor: Guy L. Hogue, Atascadero, Calif.

[73] Assignee: Hogue Combat Grips, Inc., Los Osos, Calif.

[21] Appl. No.: 178,686

[22] Filed: Aug. 18, 1980

[51] Int. Cl.[3] ..... F41C 23/00

[52] U.S. Cl. ..... 42/71 P

[58] Field of Search ..... 42/71 P

[56] References Cited

U.S. PATENT DOCUMENTS 4,199,887 4/1980 Hogue ..... 42/71 P 4,276,709 7/1981 Bross ..... 42/71 P

*Primary Examiner*—Charles T. Jordan

*Attorney, Agent, or Firm*—Brown & Martin

[57] ABSTRACT

A fastener for fastening a unitary hand grip to a pistol having a butt frame section with downwardly extending front and rear portions that are interconnected at their lower ends by a foot portion. The fastener has a yoke with side members which straddle the foot portion of the butt section. Locking pawls formed at the upper ends of the side member permits insertion of the butt section between the yoke side members but serve to prevent withdrawal of butt section once inserted. The inside of the unitary hand grip is close to the outer surfaces of said socket members and prevent the opening of the locking pawls of the fastener when the unitary hand grip is installed.

6 Claims, 3 Drawing Figures

CLOTHES PIN STIRRUP FASTENER FOR UNITARY PISTOL HAND GRIP

BACKGROUND OF THE INVENTION

Pistols in general have a frame with a butt section which is cut out for lightness and to accommodate firing spring used in most pistols, leaving downwardly extending front and rear members which are interconnected at their lower ends by a foot portion. U.S. Pat. No. 4,199,887 discloses a unitary hand grip which covers the butt frame section of a pistol and is secured thereto by fastener means which includes a yoke straddling the foot of the butt frame section, and means for securing the top of the yoke to the foot, and screw means attaching the bottom of the yoke to the bottom of the unitary hand grip. In one form of the fastener, the yoke has an open top, and a roller which rides on the top of the foot is rotatably mounted across the open top of the yoke by means of a pin which is engaged in openings in the upper sides of the yoke adjacent to the open top. It has been found, however, that the kick due to firing the pistol and other shocks received during use, tend to dislodge the pin upon which the roller is mounted and to disconnect the pin from one side of the yoke, thereby disconnecting one side of the yoke from the foot of the butt frame section and thus allowing it to move when the pistol is fired. Such movement of the pistol grip decreases the accuracy of the pistol.

SUMMARY OF THE INVENTION

The preferred embodiment of the fastener described herein has a yoke with resilient side members that straddle the foot portion of the butt section of the pistol, locking pawls extending between the side members above the foot portion, and screw means for attaching the bottom of the yoke to the bottom of the unitary hand grip. The locking pawls are truncated chock shaped elements formed at the upper ends of the side members. The tapered ends of the chocks meet without touching midway between the side members to enclose the space between the upper surface of the yoke and the side members. The inclined surfaces of the chocks form a V-shaped notch to facilitate the spreading apart of the side members for insertion of a pistol butt section into the fastener. When the unitary hand grip is installed on the pistol, the inside surfaces of the hand grip bear against the side members of the fastener forcing the locking pawls together to securely hold the butt section within the fastener.

The principle object of the invention is to provide a new and improved fastener for unitary pistol hand grips which maintains the pistol grip in place under conditions of heavy usage. Other advantages of the invention are to provide a fastener for unitary pistol hand grips which is simple in design and use, of sturdy construction, and readily manufactured. Other advantages of the invention will be apparent from the detailed description contained herein.

DESCRIPTION OF THE PREFERRED EMBODIMENT

Figure 1:
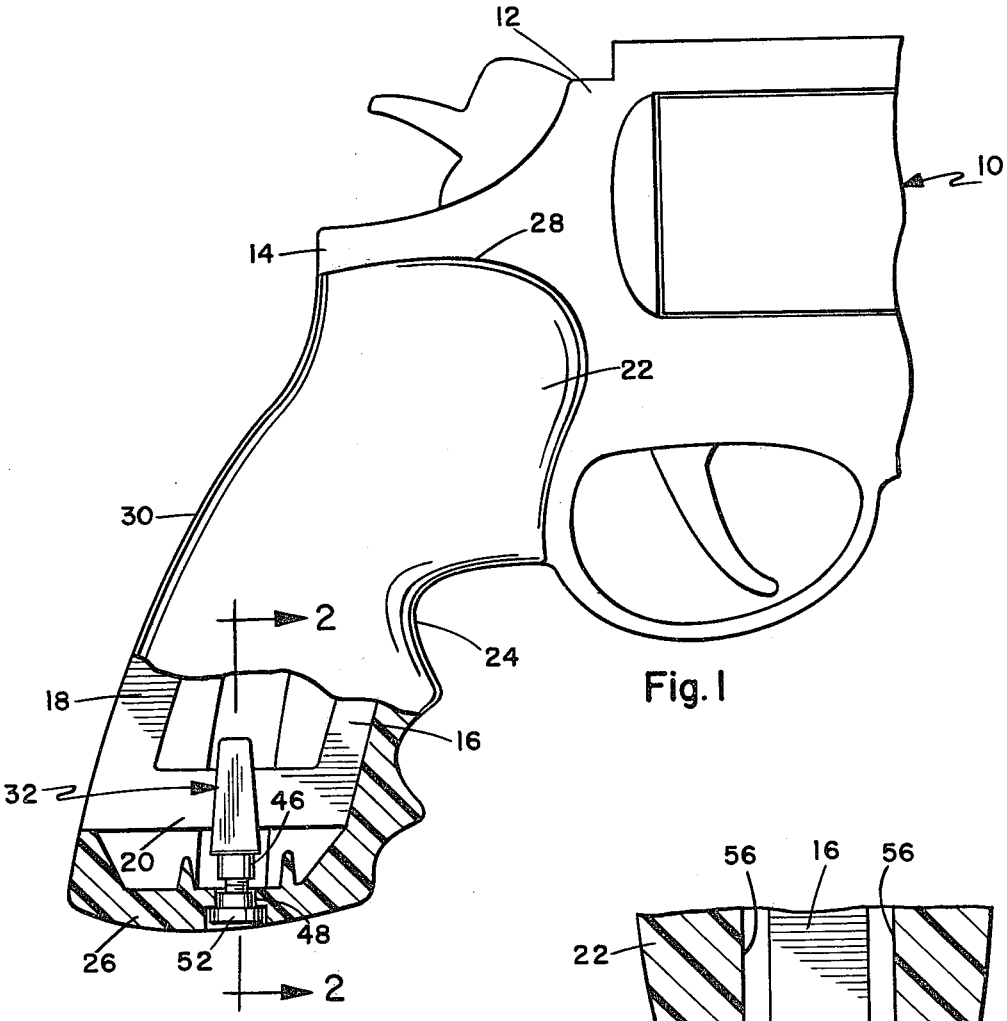
FIG. 1 is a side elevation view of a typical revolver with a one piece grip attached, a portion of the grip being cut away to reveal the fastener.

FIG. 1 illustrates the butt portion of a pistol 10 having a frame 12 with a butt portion 14. The frame butt portion 14 is cut out for lightness and to accommodate the firing spring used in most revolvers, leaving a downwardly extending rear member 18, and a foot portion 20 interconnecting the lower ends of the frame members. A unitary hand grip 22, which has a closed front 24, a closed bottom 26, an open top 28, and an open rear 30, snuggly covers the frame butt portion 14. The unitary hand grip 22 can be made of wood, plastic, or any other suitable material.

Figure 2:
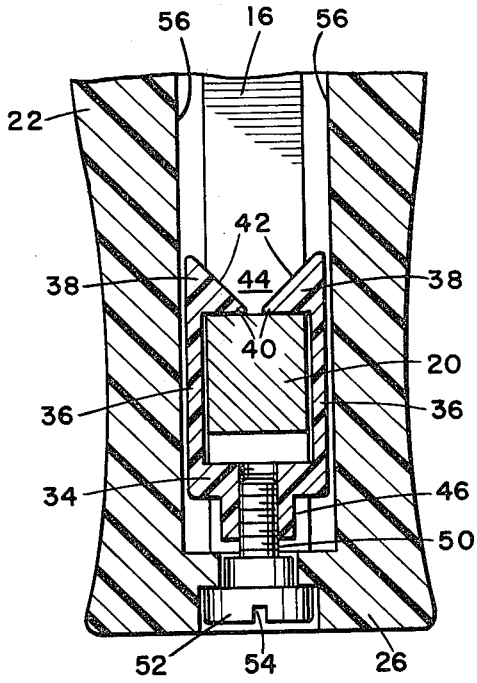
FIG. 2 is an enlarged sectional view taken on line 2—2 of FIG. 1.
Figure 3:
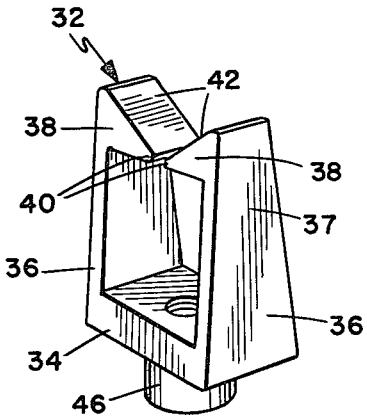
FIG. 3 is an enlarged perspective view of the clothes pin stirrup fastener.

The fastener 32 is shown in more detail in FIGS. 2 and 3. It consists of a yoke 34 with upwardly extending resilient side members 36. The faces of side members 36 have tapered sections 37 with their greatest width at yoke 34 and their minimum width at the locking pawls 38. This taper permits small rotational movement of fastener 32 to facilitate its installation within hand grip 22. Locking pawls 38 are formed at the upper ends of the side members 36, and are chock shaped elements whose tapered ends 40 extend toward one another to meet without touching midway between the side members 36. The inclined surfaces 42 of locking pawls 38 form a V-shaped notch 44 which facilitate the spreading apart of side members 36 and insertion of foot portion 20 of pistol frame 12 into the fastener 32. Once foot portion 20 is inserted, the spring action of side members 36 cause locking pawls 38 to return to their normal positions and enclose foot portion 20 within the fastener 32.

Threaded collar 46 extends downwardly from yoke 34 and aligns with hole 48 in the bottom 26 of the pistol grip. Locking screw 50 passes through hole 48 and is threaded into collar 46 to secure yoke 34 to pistol grip bottom 26. Screw head 52 has a slot 54 cut such that screw 50 may be turned by a hand cuff key, a screwdriver, or a coin.

As shown in FIG. 2, when the unitary hand grip 22 is installed on the pistol, its interior surfaces 56 bear against side members 36 forcing locking pawls 38 together and thus securely retaining foot portion 20 of the pistol within the fastener 32.

I claim:

1. A fastener for use in combination with a pistol having a cutout butt frame portion with downwardly extending front and rear members and a foot portion extending between the lower ends of said front and rear members, and a unitary hand grip covering said butt frame section, said unitary hand grip having a closed bottom, the fastener comprising:

a yoke having a cross bar below said foot portion and upwardly extending side members straddling said foot portion, locking pawls formed at the upper ends of each of said side members permitting insertion of said foot portion between said yoke side members but preventing the removal of said foot portion once inserted, and screw means for securing said unitary hand grip to said cross bar.

2. A fastener as recited in claim 1 wherein:

the faces of said side members have a tapered length with its greatest width at said cross bar.

3. The fastener recited in claim 1 wherein:

said locking pawls are formed as truncated chock shaped elements, integral with said side members ends, and having their tapered ends extending to meet without touching midway between said side members, the inclined surfaces of said locking pawls forming an entry into the space between said side members.

4. The fastener as recited in claim 1 wherein there is an opening in the bottom of said unitary hand grip, and wherein said screw means comprises:

a threaded collar attached to said cross bar and extending downwardly therefrom, and a screw extending through said opening in the bottom of said hand grip and threadable into said collar.

5. The fastener recited in claim 4 wherein the head of said screw has a radial slot to receive a compatible end of a hand cuff key.

6. The fastener recited in claim 1 wherein:

said fastener is formed of high tensil strength, impact resistant, plastic.

* * * * *